United States Patent [19]

Maekawa et al.

[11] 4,440,488

[45] Apr. 3, 1984

[54] CLEANING DEVICE FOR AN IMAGE-CARRYING MEMBER

[75] Inventors: Takashi Maekawa; Shoji Matsumoto; Toshikazu Matsui, all of Osaka, Japan

[73] Assignee: Mita Industrial Company Limited, Osaka, Japan

[21] Appl. No.: 411,479

[22] Filed: Aug. 25, 1982

[30] Foreign Application Priority Data

Sep. 3, 1981 [JP] Japan ..... 56-139283

[51] Int. Cl.[3] ..... G03G 15/08

[52] U.S. Cl. ..... 355/15; 355/3 DD; 430/125; 118/652

[58] Field of Search ..... 355/15, 3 DD, 14 D; 118/652; 430/125

[56] References Cited

U.S. PATENT DOCUMENTS

| | | | |
|---|---|---|---|
| 3,660,863 | 5/1972 | Gerbasi | 355/15 |
| 3,859,691 | 1/1975 | Katayama et al. | 15/256.51 |
| 3,871,762 | 3/1975 | van der Vlasakker | 355/15 |
| 4,026,648 | 5/1977 | Takahashi | 355/15 |
| 4,152,067 | 5/1979 | Kubota | 355/15 |
| 4,255,044 | 3/1981 | Cormier et al. | 355/15 |
| 4,264,191 | 4/1981 | Gerbasi et al. | 355/15 |
| 4,284,345 | 8/1981 | Sugiyama et al. | 355/15 |
| 4,297,026 | 10/1981 | Honda et al. | 355/15 |
| 4,334,766 | 6/1982 | Sugiyama et al. | 355/15 |
| 4,357,098 | 11/1982 | Endo | 355/15 |

*Primary Examiner*—A. C. Prescott

*Attorney, Agent, or Firm*—Wenderoth, Lind & Ponack

[57] ABSTRACT

A cleaning device for an image-carrying member includes an elastic blade having a proximal end fixed to a holder and a terminal end held against the image-carrying member for removing toner from the image-carrying member upon movement of the image-carrying member. The terminal end of the blade flexes to extend forward in the direction of movement of the image-carrying member at an angle of $\alpha$ to a line tangential to a surface of the image carrying member rearward of a contact point between the terminal end of the blade and the image carrying member with respect to the direction of movement thereof. The blade has an axis passing through the proximal end of the blade and extending at an angle of $\theta$ to the tangent rearward of the contact point with respect to the direction of movement of the image-carrying member. The angles $\alpha$ and $\theta$ are selected to meet the following relationship:

$$\theta > 90° > \alpha.$$

4 Claims, 2 Drawing Figures

CLEANING DEVICE FOR AN IMAGE-CARRYING MEMBER

BACKGROUND OF THE INVENTION

1. Field of the Invention

The present invention relates to a cleaning device for removing residual toner from the image-carrying member, after the step of transferring a toner image, in a transfer-type electrostatic copying method, and more particularly to such a cleaning device including an elastic scraper blade having a proximal end fixed to a blade holder and a terminal end held in contact with the image-carrying member.

2. Description of the Prior Art

In a prior art arrangement, residual toner after a toner image has been transferred can be removed from an image-carrying member by a scraper blade pressed against a circumferential surface of the image-carrying member. The stronger the force with which the scraper blade is held in contact with the image-carrying member, the greater the reliability of toner removal, but the more the tendency for the image-carrying member to become damaged by the scraper blade. No prior art arrangement has been successful in fully solving such a contradictory problem.

It is an object of the present invention to provide a cleaning device for an image-carrying member for reliably removing residual toner from an image-carrying member without damaging the latter.

SUMMARY OF THE INVENTION

The above object can be achieved by a cleaning device for an image-carrying member which includes an elastic blade having a terminal end flexing to extend forward in the direction of movement of the image-carrying member at an angle of $\alpha$ to a line tangential to a surface of the image-carrying member rearward of a contact point between the terminal end of the blade and the image-carrying member with respect to the direction of movement thereof. The blade has an axis passing through the proximal end of the blade and extending at an angle of $\theta$ to the tangent rearward of the contact point with respect to the direction of movement of the image-carrying member. The angles $\alpha$ and $\theta$ are selected to meet the following relationship:

$$\theta > 90° > \alpha.$$

According to the present invention, the angle $\theta$ formed between the tangent at the contact point between the terminal end of the blade and the image carrying member and the axis of the blade passing through the proximal end thereof rearward of the contact point with respect to the direction of movement of the image-carrying member is selected to exceed 90° so that the force with which the terminal end of the blade is held against the image-carrying member will be increased. In order to cause the force exerted on the image-carrying member to act along the tangent as much as possible, the angle $\alpha$ formed between the tangent and the terminal end of the blade rearward of the contact point with respect to the direction of movement of the image-carrying member is selected to be smaller than 90°. Thus, the terminal end of the blade is capable of being held in contact with the image-carrying member under a large tangential force for reliably removing residual toner from the image-carrying member. The image-carrying member is prevented from being damaged since it is subjected to a small component of force acting thereon radially inwardly.

According to a preferred embodiment of the invention, the image-carrying member may comprise a photosensitive member or dielectric member.

DETAILED DESCRIPTION OF THE PREFERRED EMBODIMENT

Figure 1:
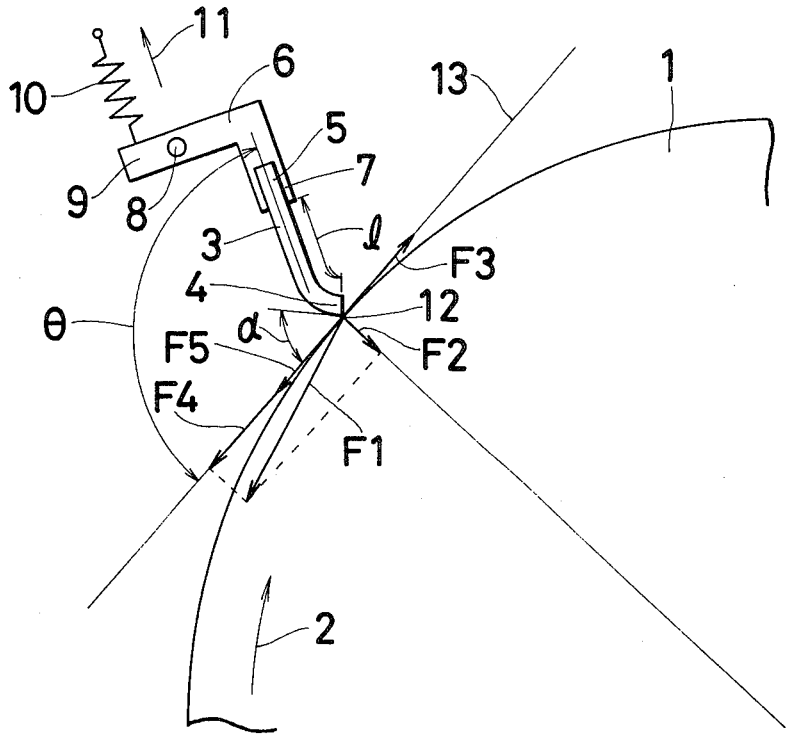
FIG. 1 is a schematic cross-sectional view of a cleaning device having a scraper blade for an image-carrying member according to an embodiment of the present invention.

FIG. 1 is a partial schematic cross-sectional view of an embodiment of the present invention. An image-carrying member of a transfer-type electrostatic copying apparatus, such as a photosensitive member 1 as an image-forming member, is rotated in the direction of an arrow 2. Residual toner is removed by a scraper blade 3 from the photosensitive member 1 after a toner image has been transferred from the photosensitive member 1 to a sheet of copy paper (not shown). The scraper blade 3 is made of an elastic material such as natural rubber or synthetic rubber such as neoprene or silicone rubber. The scraper blade 3 has a terminal end 4 elastically held against a circumferential surface of the photosensitive member 1. A proximal end 5 of the scraper blade 3 is fixed to an end 7 of a blade holder 6 which is substantially in the form of a letter L. The blade holder 6 is pivotably supported on a housing of the copying apparatus by a pin 8 having an axis parallel to the axis of rotation of the photosensitive member 1. The other end 9 of the blade holder 6 is normally urged elastically by a spring 10 in the direction of an arrow 11 to cause the terminal end 4 of the scraper blade 3 to be pressed against the photosensitive member 1. The terminal end 4 of the scraper blade 3 flexes so that it extends forward in the direction 2 of rotation of the phtosensitive member 1. The terminal end 4 of the scraper blade 3 extends at an angle of $\alpha$ to a line 13 tangential to the photosensitive member 1 rearward of a point 12 at which the terminal end 4 of the scraper blade 3 is held in contact with the photo-sensitive member 1 with respect to the direction 2 of rotation of the photosensitive member 1. The scraper blade 3 has a longitudinal axis passing through the end 7 of the blade holder 6, that is the proximal end 5 of the scraper blade 3, and extending at an angle of $\theta$ to the tangent 13 rearward of the point 12 with respect to the direction 2 of rotation of the photosensitive member 1. These angles $\alpha$ and $\theta$ are selected to meet the following expression:

$$\theta > 90° > \alpha \quad (1)$$

Figure 2:
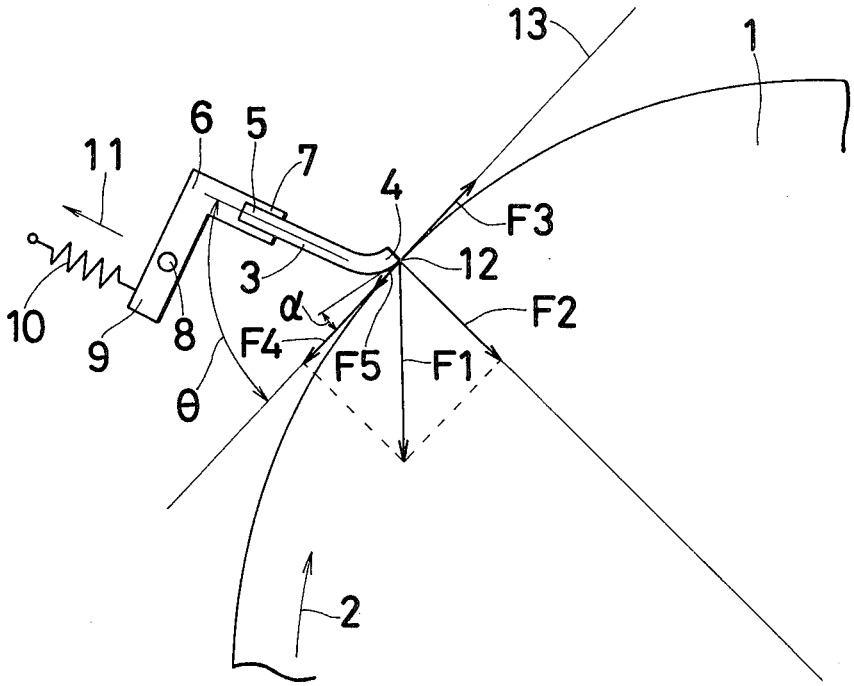
FIG. 2 is a schematic cross-sectional view of another cleaning device having a differently attached scraper blade, the view being presented here for comparison with the cleaning device according to the present invention.

FIG. 2 illustrates a cleaning device shown here for comparison with the cleaning device of FIG. 1 according to the present invention, the cleaning device of FIG. 2 having the scraper blade 3 mounted in a manner such that the angle $\theta$ is smaller than 90°. Identical parts shown in FIG. 2 are denoted by identical reference characters in FIG. 1. A study of FIGS. 1 and 2 indicates that a force F1 with which the terminal end 4 of the scraper blade 3 is held against the photosensitive member 1 at the point 12 can be increased by selecting the angle $\alpha$ to be as small as possible below 90°. However, with the arrangement of FIG. 2 in which the angle $\alpha$ is relatively small and the angle of $\theta$ is smaller than 90° to increase the force F1, a component of force F2 of the force F1 which is directed radially inwardly of the photosensitive member 1 becomes larger as compared with the component of force F2 shown in FIG. 1. The component of force F2 acts directly on the photosensitive member 1 and hence is liable to injure the photosensitive member 1 if the component of force F2 is relatively large.

When the photosensitive member 1 rotates in the direction of the arrow 2, a frictional force F3 is developed between the terminal end 4 of the scraper blade 3 and the photosensitive member 1, the frictional force F3 being opposite to a component of force F4 of the force F1 which is directed along the tangent 13. Residual toner attached to the circumferential surface of the photosensitive member 1 can be scraped off by the scraper blade 3 under a resultant frictional force F5 which is a combination of the frictional force F3 and the component of force F4. Accordingly, with the angle of $\theta$ being smaller than 90° as shown in FIG. 2, the component of force F4 is smaller than the component of force F4 produced by the present invention of FIG. 1, so that the frictional force F5 of FIG. 2 is also smaller than the frictional force F5 of FIG. 1.

With the arrangement of the present invention, the angle $\alpha$ is selected to be as small as possible below 90° in order to maximize the force F1. The angle $\theta$ is selected to be larger than 90° in order to reduce the component of force F2 which would be responsible for damage to the photosensitive member 1 and to increase the frictional force F5 for scraping residual toner off the photosensitive member 1. For the above reasons, the angles of $\alpha$ and $\theta$ are selected in the range as defined by the above-mentioned expression.

According to the present invention, since the blade 3 is held under a large frictional force against the circumferential surface of the photosensitive member 1 when the photosensitive member rotates, residual toner is reliably removed from the photosensitive member 1 after a toner image has been transferred therefrom.

The forces F1 through F5 can be substantially uniform across the width of the scraper blade 3 in the axial direction of the photosensitive member 1 by increasing the length from the terminal end 4 of the scraper blade 3 to the end 7 of the blade holder 6.

Experiments conducted by the present inventors indicate that the best result was attained when for example, the scraper blade 3 is made of rubber having a durometer hardness of 78° measured by a Durometer (type A) as prescribed under JIS K 6301, and the scraper blade had a thickness of 2 mm and a length of 13.5 mm.

According to another embodiment of the invention, the image-carrying member may include not only a photosensitive member but also, for example, dielectric member.

The invention may be embodied in other specific forms without departing from the spirit for essential chracteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A cleaning device for an image carrying member which includes an elastic blade having a proximal end fixed to a holder and a terminal end held against said image carrying member for removing toner from said image-carrying member upon movement of the image-carrying member, wherein said terminal end of said blade is flexing to extend forward in the moving direction of the image-carrying member at an angle of $\alpha$ to a line tangential to a surface of said image-carrying member rearward of a contact point between said terminal end of the blade and said image-carrying member with respect to said direction, and said blade has an axis passing through said proximal end of said blade and extending at an angle of $\theta$ to said line rearward of said point with respect to said direction, said angles $\alpha$ and $\theta$ being selected to meet the following relationship:

$$\theta > 90° > \alpha.$$

2. A cleaning device for an image-carrying member according to claim 1, wherein said holder is substantially L-shaped, and includes a pin having an axis orthogonal to said direction and on which said holder is pivotably supported, said proximal end of said blade is fixed to an end of said holder, and a spring is connected to the other end of said holder for elastically urging said holder in a direction to cause said terminal end of said blade to be held against said image-carrying member.

3. A cleaning device for an image-carrying member according to claim 1, wherein said image-carrying member is a photosensitive member.

4. A cleaning device for an image-carrying member according to claim 1, wherein said image-carrying member is a dielectric member.

* * * * *